United States Patent [19]

Rucker

[11] 4,215,631

[45] Aug. 5, 1980

[54] SEALED PYROTECHNIC DELAY

[75] Inventor: Klaus G. Rucker, Kinnelon, N.J.

[73] Assignee: The United States of America as represented by the Secretary of the Navy, Washington, D.C.

[21] Appl. No.: 119,033

[22] Filed: Feb. 25, 1971

[51] Int. Cl.[3] ..... F42B 3/10

[52] U.S. Cl. ..... 102/27 R

[58] Field of Search ..... 102/27, 70

[56] References Cited

U.S. PATENT DOCUMENTS

| | | | |
|---|---|---|---|
| 2,736,263 | 2/1956 | Lewis | 102/27 R |
| 3,169,480 | 2/1965 | Seavey | 102/27 R |
| 3,306,201 | 2/1967 | Noddin | 102/27 R |
| 3,342,133 | 9/1967 | Ström et al. | 102/27 R |

*Primary Examiner*—David H. Brown

*Attorney, Agent, or Firm*—Richard S. Sciascia; Don R. Doty; William T. Skeer

[57] ABSTRACT

Disclosed is an improved underwater half-second pyrotechnic delay device having an elongated tubular housing with a pair of holes for respectively threading suitable detonating cords through each end thereof. In operational burning series within said tubular housing are a plurality of lead sheathed protected explosives, a resilient pressure attenuating disc, a metallic capsule containing a calibrated delayed burning composition of 2/98B-$Pb_3O_4$ having such geometrical configuration as to effect burning therealong for one-half second with considerable accuract, and another series of lead sheath protected explosives, a base charge, an explosive cord, and an end plug. An appropriate number of crimps are made along said tubular housing for holding the aforesaid elements in their proper places therein. Seals are employed at each end of said housing to make it watertight.

17 Claims, 2 Drawing Figures

SEALED PYROTECHNIC DELAY

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The present invention relates generally to pyrotechnic devices and more particularly to explosive control devices. In even greater particularity, it is a safe, underwater, water-hammer and shock resistant, half-second pyrotechnic delay device which will accurately and reliably delay the detonation along a detonating cord, fuse, powder train, or the like, when inserted between two sections or lengths thereof. The cord initiated after the delay period can be of a type that detonates, deflagrates, or burns.

DESCRIPTION OF THE PRIOR ART

Heretofore, numerous pyrotechnic delay devices have been used for timing the detonation or burning along a detonating or other pyrotechnic cord to, in turn, time the detonations of explosive charges for seismic, mine sweeping, and many other practical purposes and have been eminently satisfactory therefor. Nevertheless, with respect to situations where they were subjected to the shock waves of underwater explosions, practically all of them failed becase they were not sufficiently shock resistant to not be damaged, destroyed, prematurely fired, or otherwise be caused to malfunction by water hammer. In addition, in many instances, the reliability and timing accuracy left a great deal to be desired in the devices of the prior art because the materials, chemical compositions, structural components, and combinations thereof were not as technically advanced as many operational circumstances actually required. Accordingly, even though they were perhaps adequate for some purposes, for the purpose of accurately and safely controlling the detonation of explosive charges under water, while they, themselves, were submerged therein in sufficient proximity thereto to be exposed to the water hammer and shock waves caused thereby, they ordinarily were inferior and, in some instances, would not work at all. Hence, the need for new and improved underwater pyrotechnic delay devices has, from time to time, become apparent.

SUMMARY OF THE INVENTION

The present invention overcomes many of the disadvantages of the prior art devices, in that it is constructed so that it may be used underwater in the presence of explosive charges and, within reasonable limits, is highly resistant to destruction or malfunction as a result of being exposed to water hammer and shock waves caused by the detonation thereof.

It is, therefore, an object of this invention to provide an improved pyrotechnic delay device.

Another object of this invention is to provide an improved half-second pyrotechnic delay device.

A further object of this invention is to provide an improved method and means for controlling the timing of detonation of explosive charges.

Still another object of this invention is to provide an improved method and means for effecting and controlling seismic explosions.

Another object of this invention is to provide an improved method and means for neutralizing, detonating, and sweeping programmed pressure responsive marine mines.

A further object of this invention is to provide a pyrotechnic delay device that will delay the burning or detonation along a pyrotechnic or detonating cord a predetermined amount.

Another object of this invention is to provide a pyrotechnic delay device that can withstand water hammer and shock waves caused by the detonation of explosive charges in reasonable proximity therewith while being submerged within a predetermined environmental medium, such as water, sea water, or the like, without being destroyed or disabled.

Another object of this invention is to provide a pyrotechnic delay that is not influenced adversely by the shock wave and water hammer from the input detonating cord.

A further object of this invention is to provide a safe fuse system for accurately timing the firing of powder or other explosive charges within an environment that would otherwise be hazardous due to shock waves, explosion pressures, and other deleterious physical and/or chemical phenomenon.

Still another object of this invention is to provide a pyrotechnic delay device which has unidirectional burning characteristics, in that it will, for example, only burn from, say, the input end to the output end and not vice versa.

Another object of this invention is to provide a pyrotechnic delay which does not tend to be desensitized by hydrostatic pressures and, thus, fails to timely propagate the requisite ignition energy to an explosive charge associated therewith.

Another object of this invention is to provide an improved pyrotechnic delay that facilitates the accurate and reliable actuation of explosive charges in a predetermined sequence and at precise delay intervals for seismic exploration, well cleaning, underwater signaling, echo-search-ranging, target detection, and the like, purposes.

A further object of this invention is to provide a pyrotechnic delay device whose delay may be varied very simply by varying the manufactured length thereof, the chemical composition of the delay, or both.

Another object of this invention is to provide an improved pyrotechnic delay device which is very resistant to desensitization or inadvertent actuation as a result of the impact and abrasive actions thereon by its ambient environmental elements.

Another object of this invention is to provide a sealed pyrotechnic delay device that is not readily disabled by water seepage thereinto during underwater operations at great depths.

Another object of this invention is to provide a method and means for accurately delaying the propagation of fire a predetermined amount at one or more locations along a fuse or explosive cord.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
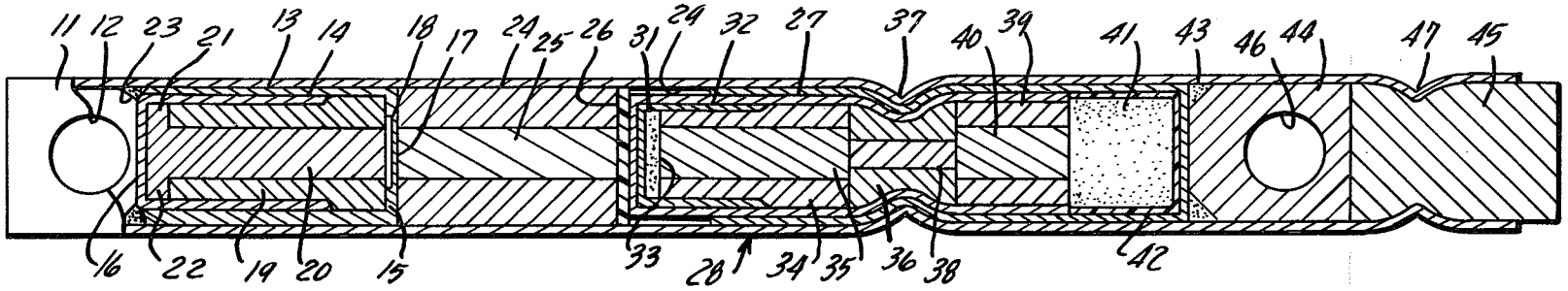
FIG. 1 is an elevational view, partially in cross-section, and partially with parts broken away, of the pyrotechnic delay device constituting this invention.

Referring now to FIG. 1, a preferred embodiment of the subject invention is depicted as having its rearward or input end on the left and its forward or output end on the right. For the purpose of keeping this disclosure as simple as possible, it will be discussed from a structural standpoint in the direction of pyrotechnic performance, viz, burning and detonation from rear to front, or from left to right.

Shown is a commercial bronze tube 11 (the dimensions of which may be, for example, 3.563 in. long by 0.310 in. OD by 0.025 in wall) which acts as a housing for all of the elements making up the entire delay device. Although commercial bronze is herewith indicated as being the material of which tube 11 is preferably manufactured, numerous other metals and materials are suitable therefor. For example, some of such materials are steel, nickel, copper, other bronze, brass, aluminum, plastics, or polymeric materials, and the like, having the required physical and chemical characteristics for any given operational circumstances. Of course, since the invention disclosed herewith is primarily intended to be used underwater and, thus, be exposed to the pressures, water hammers, and shock waves as a result of its being exposed to the detonation of underwater explosives, it should have its outer housing constructed of material that is strong enough to withstand such ambient hydrostatic and hydrodynamic pressures and whatever abrasive conditions are present in underwater operations.

A first hole 12 is drilled through tube 11 of one end thereof, with the axis of said hole preferably being normal to the longitudinal axis of the entire tube. Of course, inasmuch as said hole will have a detonating cord—preferably a nylon braided flexible detonating cord—inserted therethrough, its dimensions should be such as would effect a firm friction accommodation therewith. Contiguously disposed with and immediately forward of said hole 12 is a metal capsule 13 consisting of a pair of commercial bronze container shells 14 and 15, with the former telescopically disposed in friction fit within the latter. Said shell 14 may, for example, be designed to be 0.438 inches long by 0.256 inches outside diameter by 0.015 inches wall thickness; and said shell 15 may, for example, be dimensioned to be 0.438 inches long by 0.273 inches outside diameter by 0.01 inches wall thickness by 0.005 inches wall thickness at the front end thereof. Shells 14 and 15 respectively have end walls 16 and 17, the latter of which has a cut 18 included therein in such manner that it is thinned sufficiently (say, to the aforementioned 0.005 inches thickness) as to have a predetermined rupture characteristic when exposed to explosive pressures, as will be explained in greater detail subsequently in conjunction with the discussion of the operation of the subject invention. A lead protector sheath or tube 19, preferably designed to be 0.5 inches long by 0.221 inches outside diameter by 0.11 core or inside diameter, is inserted in complementary fit within said telescopically disposed shells 14 and 15. The core 20 thereof, of course, extends through the length of lead tube 19, with the longitudinal axis thereof preferably coincident with the longitudinal axis of tube 11. As may be seen, the length of lead tube 19 is not quite great enough to completely fill shells 14 and 15 and that a space 21 is, thus, left at the end thereof adjacent to end 16 of shell 14. Disposed within the core hollow 20 of lead tube 19 and space 21 in such manner as to fill both thereof is a "T-shaped" 0.5 gr. RDX (cyclotrimethylenetrinitramine) detonation sensitive materal 22, the chemical composition of which is $C_3H_6N_6O_6$.

In order to hold capsule 13 in its proper place in tube 11 and with respect to hole 12, polyurethane seals 23 is molded against the inside surface of tube 11 and the left ends of shells 14 and 15 to thereby effect a watertight seal thereat. For this purpose, DuPont's Imron 829-912 may be used, or if storage time is limited, Goodyear's Pliobond, or other polymeric sealer, may be used, if so desired.

Forward of end 17 of container shell 15, a hollow lead protector sheath or tube 24 is located within tube 11 in such manner that the outside diameter is compatible with the inside diameter thereof. The inside diameter or core of tube 24 is preferably about the same as that of lead tube 19. Within the core of lead tube 24 is disposed a flexible explosive cord 25 which may, for example, be of the Detasheet type manufactured by the E. I. DuPont De Nemours & Company. Both tube 24 and explosive cord 25 have their rearward ends in contact with the forward surface of end wall 17 of shell 15 and their forward ends in contact with the rear surface of a 1/32 inch thick chloroprene type material disc 26, preferably having a Shore hardness rating of 50 to 60. For such purpose, it has been found that disc 26 may be made of "Neoprene" that is manufactured by the E. I. DuPont De Nemours & Company, inasmuch as it is readily available therefrom and has all of the required physical and chemical characteristics.

In forward abutment with disc 26 is a commercial bronze capsule or container shell 27, which, in fact, constitutes the outer metallic housing for a pyrotechnic delay assembly 28. Shell 27 may, for instance, be designed to have whatever length is necessary to effect whatever pyrotechnic delay is desired, but, for the half-second delay embodiment, it has been dimensioned to be approximately 0.813 inches long by 0.273 inches outside diameter by 0.260 inside diameter by 0.010 inch bottom. Accordingly, between the rear rim thereof and the forward face of disc 26 is an air space 29.

Another commercial bronze container shell 31 (preferably dimensioned to be 0.813 inches long by 0.256 outside diameter by 0.236 inches inside diameter by 0.030 inch bottom) is snugly fit within shell 27, and disposed therein in abutment with the rearward inside surface thereof is a commercial bronze opened capsule 32, preferably dimensioned to be 0.313 inches long by 0.234 inches outside diameter by 0.214 inches inside diameter by 0.019 inch bottom, with the open end thereof facing in the forward direction. A disc-shaped ignition charge 33, preferably made of a percussion mix of boron-red lead (2/98 B-$Pb_3O_4$) powder compounded with 1% neoprene is disposed within capsule 32 against the front face of the rearward wall of shell 31. A lead carrier tube 34 of such outside dimension as to be fit snugly within shells 31 and 32 is disposed therein. The inside core thereof is loaded with the delay powder 35 of such composition as would produce the delay burning time desired. In the case of the subject half-second pyrotechnic delay, the dimensions of said delay carrier would be 0.430 inches long by 0.228 inches outside diameter when loaded at 325 lb. with a flat pin. Of course, both tube 34 and delay powder 35, thus, are in abutment with the forward face of the aforesaid disc-like ignition charge 33.

Delay carrier powder 35 is preferably made of 2/98-B-$Pb_3O_4$, but it should be understood that any other appropriate pyrotechnic material may be substituted therefor in the event it is found to be advantageous to do so. Obviously, so doing, as well as providing the proper dimensions therefor to effect any desired burning time or rate, would be well within the purview of one skilled in the art having the benefit of the teachings herewith provided.

Another lead carrier tube 36, substantially comparable in substance and operation as the aforementioned lead tubes, is disposed in abutment with the forward end of lead tube 34; however, the inside diameter of the hollow thereof is not as great as the inside diameter of the aforesaid lead tube 34. Consequently, the wall thickness thereof is strong enough to withstand a crimp 37, which, of course, holds it and the aforesaid commercial bronze shells 11, 30, and 31 in their respective places relative to each other. Disposed within the substantially uniform diameter hollow of lead tube 36—which exists in spite of crimp 37—is a 32 gr. per ft. RD-1333 lead azide charge 38 (loaded at 200 lb. with a flat pen), and it contacts the front face of the aforesaid 2/98-B-$Pb_3O_4$ delay carrier 35. Another lead carrier tube 39 having a larger inside diameter than that of tube 36 abuts the front end thereof, and disposed therein is a vibration loaded superfine PETN (pentaerythritol tetranitrate) charge 40 of $C_5H_8O_{12}N_4$. In abutment with said PETN charge 40, at the front end thereof, is a base charge 41 of 3.5 gr. RDX ($C_3H_6N_6O_6$) which, in turn, is disposed within a plastic cup or liner 42 (such as, for example, polyethylene, Teflon, or polytetrafluoroethylene) for the containment with the forward end of bronze shell 30. The plastic cup or liner 42 decouples the RDX base charge from shock waves and water hammer that hit the delay structure.

Again, a front polyurethane seal 43 is located at the forward end of shell 30, so as to form a watertight seal between it and the inside diametrical surface of tube 11, in a manner similar to that of rearward watertight polyurethane seal 23. And in front thereof is an explosive slug 44, cut from ¼ inch plastic bonded sheet explosives cord, sandwiched between the front surface of tube 27 and the rear surface of a neoprene (chloroprene) plug 45 inserted in the forward end of tube 11. Another hole 46 is drilled through tube 11, and the matching opening through the explosive cord slug 44 is formed with a plastic punch and, thus, are suitable for another length of pyrotechnic cord to be inserted therein. Plug 45 is preferably held in place as a result of a crimp 47 being put near the end of tube 11. Of course, retention of plug 45 in such manner also aids crimp 37 and seals 23 and 43 to effect retention of all of the aforementioned elements within tube 11, the housing of the entire pyrotechnic delay.

At this time, it should perhaps be noteworthy that all of the materials and chemical compositions used in this invention are well known and conventional per se; hence, it is to be understood that it is their respective configurations and their concerted interconnections and interactions which combine to constitute the new and improved pyrotechnic delay constituting this invention and which effects the new and improved results produced thereby.

Figure 2:
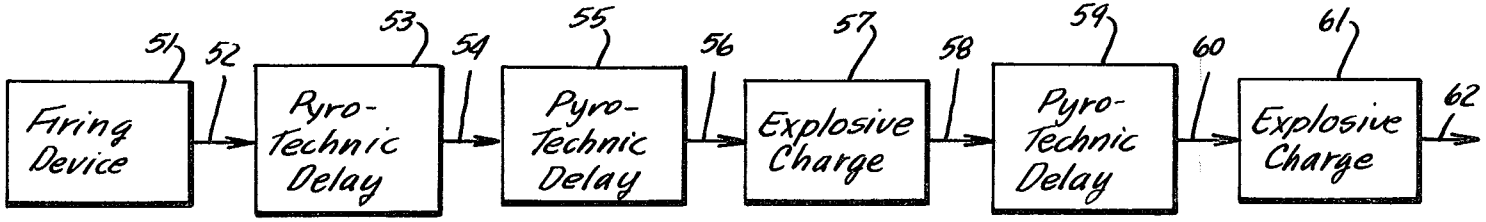
FIG. 2 is a block diagram of a representative system in which the subject pyrotechnic delay device may be incorporated to an advantage.

FIG. 2 discloses a representative system configuration which may incorporate one or more of the subject half-second pyrotechnic delays to an advantage. Shown therein is a suitable detonation or firing device 51 adapted for initiating the burning of the explosive train to which it is attached. Connected to the output thereof is a detonating cord material 52, and connected in series with cord 52 is a pyrotechnic delay 53, another detonating cord 54, another pyrotechnic delay 55, another cord 56, and an explosive charge 57, the latter of which is of any type that is appropriate for the operational conditions involved. Connected in series thereto is another detonating cord 58, another pyrotechnic delay 59, another cord 60, and another appropriate explosive charge 61.

The foregoing is, of course, merely exemplary, inasmuch as the subject pyrotechnic delays could be used in other arrangements if so desired. Moreover, if warranted by operational circumstances, additional delay elements, cords, charges, and any other suitable utilization apparatus may be effectively connected to explosive charge 61 by means of connector 62. Obviously, so doing would merely involve the making of design choices and, thus, would be well within the purview of one skilled in the art having the benefit of the teachings presented herewith.

Each of the aforesaid cords and explosive charges may be of any appropriate type that will cause them to function as desired during any given operational circumstances. However, it has been found that "Detaflex" nylon-braided flexible high explosive cord and "Detasheet" flexible high explosive sheet charges—both of which are manufactured by the Explosives Department of the E. I. DuPont De Nemours and Company of Wilmington, Del.—are eminently satisfactory therefor, respectively. Of course, any conventional firing means may be employed as firing device 51.

Obviously, the particular array, train, or series arrangement of the elements of FIG. 2 would depend on the use intended therefor. Hence, the arrangement of FIG. 2 is representative only and, thus, should not be considered as limiting the invention thereto.

MODE OF OPERATION

The operation of the subject invention will now be discussed briefly in conjunction with both of the figures of the drawing.

Although it should be understood that the invention will function within many different environmental mediums—such as, for instance, within water, sea water, the atmosphere, in earth, in space, and the like—for the purpose of keeping this disclosure as simple as possible, it will now be assumed to be operating in water in an explosive system designed and patterned in such manner as to efficiently generate water waves or pressure waves that, in turn, effect the detonation of pressure responsive marine mines in a submarine mine field.

Ostensively, the key to optimum operation of a system of the abovementioned type is the incorporation of a sealed half-second pyrotechnic delay device which can withstand a series of explosions in proximity therewith and the shock waves and water hammers resulting therefrom and still function in a reliable and accurate manner. Such a key device constitutes this invention, and the preferred embodiment thereof is portrayed in FIG. 1.

The operation thereof is really very simple. The side-priming shock wave from the detonating cord inserted through rearward hole 12 effects the ignition of the subject pyrotechnic delay device at the rear input, or left end thereof, as it is shown in said FIG. 1. For clarity, the wall thicknesses thereof have been accentuated therein, but in reality, the incoming detonation initiates the thin layer of RDX starter element material 22 located in the bottom of container shell 16. Then that column portion of RDX material 22 sheathed by lead tube 19 detonates and initiates through forward thin wall 17 of bronze shell 15 flexible explosive cord 25 located in lead tube 24. The detonation pressure of flexible explosive cord 25 hits the 1/32 inch thick "Neoprene" disc 26, travels therethrough and through the rear end walls of support shells 31 and 32 to effect ignition of 2/98 Boron/Red lead—1% "Neoprene" mixture charge 33 located within the delay element assembly. Charge 33, in turn, ignites the 2/98B-$Pb_3O_4$ delay element 35 (located in lead tube 34) which then burns for a period of time that is proportional to the column length thereof. In this particular case, the length thereof has been designed to cause it to burn for one-half second. Upon completion of the burning of delay element 35, lead azide column 38, sheathed in lead tube 36, detonates and, in turn, causes superfine PETN charge 40 to be detonated. The PETN charge 40 reliably transfers this detonation to the RDX base charge 41 located in cup 42, and as a result of the detonation of charge 41, explosive cord slug 44 is detonated through the forward ends of cup 42 and shell 27 in such manner as to cause it to ignite the explosive cord that extends through forward hole 46 of tube 11.

Polyurethane seal 43 holds shell 27 in place within tube 11, and plug 45 is inserted in the end of tube 11 to act as a support for the plastic-bonded high-explosives charge 44; and it should be noted that several crimps—such as, for example, crimps 37 and 47—are employed along the length of tube 11 to help hold the various and sundry elements contained therein in their proper places for optimum, timely interaction therebetween, respectively. Other crimps are, of course, sometimes used, in the event the length of tube 11 and its contents require them for structural strength and integrity purposes. The proper selection thereof would obviously be well within the purview of the artisan having the benefit of the teachings presented herewith.

During the final stages of operation, as previously mentioned, explosive cord slug 44 is initiated. The detonation thereof, in turn, transfers to the detonating cord located in hole 46. Although the sealed delay capsule assembly stays closed during the delay burning time, it is totally destroyed by said output detonation.

From the foregoing, it may readily be seen that the pyrotechnic delay constituting this invention works on an in-line series of burning and impact shock modes from left to right, all the way through it. In addition to increasing the length thereof to increase the delay thereof, several thereof may be connected in series, inasmuch as so doing may be a simple expedient which facilitates the varying of the system arrangement incorporating them.

The aforesaid 1/32 inch thick Neoprene disc 26 plays a significant part in the operation of the subject delay device. In actuality, it lowers the peak pressure forwardly adjacent thereto sufficiently to eliminate such difficulties as in-depth initiation of the 2/98 Boron-$Pb_3O_4$ delay element 35 (to thereby prevent short delay times) or pressure bleeding (to thereby prevent long delay times) and still provide the rapid adiabatic compression necessary to cause ignition of the thin layer of 2/98 Boron-$Pb_3O_4$. On the other hand, it and the rear walls of the shells containing the delay element constitute an obstacle of sufficient pyrotechnic resistance that the mere burning of the delay element will not cause flexible explosive cord to be detonated. Hence, pyrotechnic action can only take place in one direction within the invention, thereby preventing reverse burning therein that could cause back-burning within any fuse system that might incorporate it. This unidirectional burning feature is of considerable value in safely using the invention and, moreover, in effecting the detonation timing of all of the explosive charges associated therewith, since a chain thereof will only explode in the forward or desired direction.

From the foregoing, it may readily be seen that the subject invention achieves its objectives in such manner as to cause it to be a very worthwhile advance in the pyrotechnic delay art.

The operation of the exemplary pyrotechnic system of FIG. 2 is probably evident on its face; however, to insure its significance in the various explosive arts is thoroughly understood, the operation thereof will also be described briefly.

Firing device 51 initiates detonating cord 52 which, in turn, causes series connected pyrotechnic delays to be timely actuated as explained above. The detonating cord 56 is initiated and it causes charge 57 to be detonated, thereby originating a high-pressure shock wave within its ambient environment. Detonation of explosive charge 57 causes cord 58 to detonate and ultimately actuate pyrotechnic delay 59. Said delay impedes the detonation along the explosive train for a predetermined amount of time (according to its time delay or burning rate design) and then ignites cord 60 which, in turn, detonates another explosive charge 61.

It will, of course, be readily appreciated by the artisan that it is the physical disposition and detonation timing of the explosive charges in any given explosive train that causes whatever pressure patterns are needed in the ambient environment to effect the results desired. Accordingly, because the possible configurations thereof are practically unlimited, the applications of explosive trains using the subject invention for timing purposes are practically unlimited.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A pyrotechnic delay device, comprising in combination:

an elongated tubular housing of predetermined length;

means disposed in one end of said housing adapted for effectively attaching an input detonating cord thereto;

first explosive means located within said housing in such proximity to said first detonating cord as to be detonated by the detonation thereof;

a resilient disc disposed within said housing, with one of the faces thereof effectively in contact with said first explosive means;

a capsule disposed within said housing, with one end thereof in contact with the other face of the aforesaid resilient disc;

an igniter charge located within said capsule adjacent to the end thereof that is in contact with the other face of the aforesaid resilient disc;

a carrier delay means, adapted for burning at such a rate and for such a distance along the length thereof as to be proportional to a predetermined time period, mounted in said capsule in contact with said igniter charge;

a second explosive means disposed in said capsule adapted for being detonated in response to the burning of said carrier delay means;

a third explosive means disposed within said housing in such proximity with said capsule and said second explosive means as to be detonated by the explosion thereof; and means disposed in the other end of said housing adapted for effectively attaching a second detonating cord thereto in contiguous disposition with the aforesaid third explosive means.

2. The device of claim 1, wherein the said carrier delay means comprises a charge of 2/98B-$Pb_3O_4$.

3. A pyrotechnic delay device, comprising in combination:

an elongated tubular housing of predetermined length, having a rear input end and a front output end;

means disposed in the rear end of said housing for attaching a first detonating cord thereto;

a first closed container means located within said housing, with the rear end thereof contiguously disposed with said first detonating cord attaching means and with the front end thereof having a wall rupturable upon being subjected to a predetermined explosive force;

a first protector tube, having a hollow core through the entire length thereof and a length that is less than the length of the aforesaid first closed container means, mounted within said first closed container means in such manner that the front end thereof abuts the inside surface of the front rupturable wall of said first closed container means;

first explosive means disposed within said first protector tube and said first closed container means capable of being detonated with a predetermined explosive force that is sufficient to rupture the front rupturable wall of said first closed container means in response to the burning of said first detonating cord;

a second protector tube, having a predetermined length and a hollow core through the entire length thereof, disposed in said housing, with the rear end thereof in abutment with the front face of the front rupturable wall of said first closed container means;

second explosive means located within the hollow core of said second protector tube adapted for being detonated in response to the rupture of the front wall of said first closed container means;

a disc, having a predetermined resiliency and a given thickness, mounted in said housing with the rearward face thereof in contact with the forward ends of said second protector tube and said second explosive means;

a hollow capsule disposed within said housing, with the rear end thereof in contact with the front face of said disc;

a disc-shaped ignition charge, adapted for being ignited in response to a predetermined impact pressure, effectively mounted in said hollow capsule in such manner that the rear face thereof abuts the inside front face of the rear end of said hollow capsule;

a third protector tube, having a predetermined length and a hollow core through the entire length thereof, effectively mounted within said hollow capsule, with the rear end thereof in abutment with the front face of said disc-shaped ignition charge;

pyrotechnic delay means having a predetermined burning rate disposed in said third protector tube in such manner as to fill the core thereof;

a fourth protector tube, having a predetermined length and a hollow core extending through the entire length thereof, effectively mounted within said hollow capsule, with the rear end thereof in abutment with the front end of said third protector tube;

a third explosive means located within the hollow core of said fourth protector tube adapted for being detonated in response to the burning of the forward end of the aforesaid pyrotechnic delay means;

a fifth protector tube, having a predetermined length and a hollow core extending through the entire length thereof, effectively mounted within said hollow capsule, with the rear end thereof in abutment with the front end of said fourth protector tube;

an explosive charge located within the hollow core of said fifth protector tube adapted for being detonated in response to the explosion of said third explosive means;

a base charge effectively mounted within said hollow capsule, with the rear end thereof in contact with the front ends of said explosive charge and said fifth protector tube;

an explosive slug mounted within said housing in contact with the front surface of the front end of the aforesaid hollow capsule;

means disposed in the front end of said housing for attaching a second detonating cord thereto in such manner that it is in contact with said explosive slug; and a plug disposed within the forward end of said housing in abutment with the front end of said explosive slug.

4. The device of claim 3, wherein said elongated tubular housing, said first closed container means, and said capsule are made of commercial bronze material.

5. The device of claim 3, wherein said first, second, third, fourth, and fifth protector tubes are made of lead.

6. The device of claim 3, wherein said first explosive means comprises 0.5 gr. RDX 15 having a chemical composition of $C_3H_6N_6O_6$.

7. The device of claim 3, wherein said second explosive means comprises a predetermined explosive cord.

8. The device of claim 3, wherein said disc is a one/-thirty-second inch thick chloroprene disc having a Shore hardness of fifty to sixty.

9. The device of claim 3, wherein said disc-shaped ignition charge comprises a percussion mix of boron and red lead powdered compound and one percent chloroprene.

10. The device of claim 3, wherein said pyrotechnic delay means comprises the chemical composition 2/98B-$Pb_3O_4$.

11. The device of claim 3, wherein said third explosive means comprises lead azide.

12. The device of claim 3, wherein said explosive charge comprises a PETN superfine charge having a chemical composition of $C_5H_8O_{12}N_4$.

13. The device of claim 3, wherein said base charge comprises:

a plastic cup, with the open end thereof facing said explosive charge; and 3.5 grain RDX having a chemical composition of $C_3H_6N_6O_6$ filling said plastic cup.

14. The device of claim 3, wherein said explosive slug comprises a predetermined explosive cord.

15. The invention of claim 3 further characterized by a plurality of crimps located at predetermined positions along said elongated tubular housing in such manner as to effectively hold the remaining claimed elements contained therein in predetermined dispositions.

16. The invention of claim 3 further characterized by:

a first watertight seal mounted between the inner surface of said elongated tubular housing and the rear end of said first closed container means; and a second watertight seal mounted between the inner surface of said elongated tubular housing and the front end of the aforesaid hollow capsule.

17. The device of claim 16, wherein said first and second watertight seals comprise polyurethane material.

* * * * *